US005355697A

United States Patent [19]

Morimoto

[11] Patent Number: 5,355,697

[45] Date of Patent: Oct. 18, 1994

[54] COOLING MEDIUM CIRCUIT FOR ICE MAKING MACHINE ETC.

[75] Inventor: Ryoji Morimoto, Handa, Japan

[73] Assignee: Hoshizaki Denki Kabushiki Kaisha, Aichi, Japan

[21] Appl. No.: 105,705

[22] Filed: Aug. 12, 1993

[30] Foreign Application Priority Data

Sep. 17, 1992 [JP] Japan ..... 4-071584[U]

[51] Int. Cl.[5] ..... F25B 47/02

[52] U.S. Cl. ..... 62/278; 62/352

[58] Field of Search ..... 62/73, 81, 196.4, 278, 62/352

[56] References Cited

U.S. PATENT DOCUMENTS 3,015,939 1/1962 Brainard ..... 62/278 X
3,213,637 10/1965 Halls ..... 62/81 X
4,122,686 10/1978 Lindahl et al. ..... 62/81
4,565,070 1/1986 Raymond ..... 62/81

*Primary Examiner*—William E. Tapolcai
*Attorney, Agent, or Firm*—Koda and Androlia

[57] ABSTRACT

Disclosed is a cooling medium circuit for ice making machines and the like, comprising a freezing circuit in which a high-pressure and high-temperature vaporized cooling medium compressed in a compressor is fed to a condenser, the cooling medium liquefied through condensation in the condenser is fed to an expansion means through a first solenoid valve, the cooling medium expanded and vaporized through the expansion means is fed to an evaporator to perform heat exchange and the thus heated vaporized cooling medium is fed back to the compressor; and a hot gas circuit in which the high-pressure and high-temperature vaporized cooling medium fed from the compressor is partly by-passed to the evaporator through a second solenoid valve and a choking means to achieve ice releasing and the like in the evaporator, wherein the state of the first solenoid valve and that of the second solenoid valve can be changed over synchronously each time the ice making machine is switched to freezing operation or to ice releasing operation to assume states contrary to each other; and additionally a bypass circuit where the cooling medium fed from the condenser is designed to be partly by-passed to the compressor through a third solenoid valve. According to this constitution, the ice releasing capacity of the evaporator can greatly be improved independent of the ambient temperature.

5 Claims, 2 Drawing Sheets

COOLING MEDIUM CIRCUIT FOR ICE MAKING MACHINE ETC.

BACKGROUND OF THE INVENTION

This invention relates to a cooling medium circuit for an ice making machine and the like, which is designed to exhibit an improved defrosting and ice releasing capacity particularly under low temperature conditions when the frost deposited on the evaporator and the ice pieces formed in a freezing chamber are to be removed by feeding a high-temperature vaporized cooling medium to an evaporator.

An automatic ice making machine for making continuously a number of ice pieces such as cubes has a freezing circuit for circulating a cooling medium, in which the freezing chamber is designed to be heated by feeding a high-pressure and high-temperature vaporized cooling medium (hereinafter also referred to as hot gas) from the compressor to the evaporator attached to the freezing chamber, upon switching from freezing operation to ice releasing operation, to accelerate releasing of ice pieces formed in the ice chamber. FIG. 3, for example, shows a water injection system automatic ice making machine having a multiplicity of freezing cells opening downward to which the water to be frozen is injected to form ice cubes continuously. In this type of ice making machine, a freezing chamber 30 is disposed horizontally and has on the lower surface thereof partitions 32 intersecting one another to define a multiplicity of freezing cells 34 opening downward in a checkered pattern. An evaporator 18 communicating to a freezing circuit 22, shown in FIG. 4, runs zigzag in close contact with the upper surface of the freezing chamber 30 and forces to cool the freezing cells 34 by circulating a cooling medium during freezing operation. Meanwhile, a water tray 38 equipped with a water tank 36 in which the water to be frozen is contained is tiltably supported by a support shaft 40 immediately below the freezing chamber 30. The water tray 38 and the tank 36 are designed to be retained parallel to the freezing chamber 30 during freezing operation, whereas to be tilted clockwise on the support shaft 40 during ice releasing operation to open the freezing cells 34. A multiplicity of water jetting holes 42 and water recovering holes 44 are defined in the water tray 38 at the positions corresponding to the respective freezing cells; whereas a distribution pipe 48 communicating to a compression chamber 46 is provided on the lower surface of the water tray 38. The distribution pipe 48 also communicates to the water jetting holes 42. A pump 50 is provided on the outer surface of the tank 36 and designed to inject the water to be frozen into the respective freezing cells 34 through the distribution pipe 48 and the corresponding water jetting holes 42. The portion of the water which failed to freeze in the freezing cells 34 is recovered through the water recovering holes 44 into the tank 36.

FIG. 4 shows schematically a constitution of the freezing circuit to be suitably employed in the above-described automatic ice making machine. The freezing circuit 22 essentially has a compressor 10 for compressing a cooling medium such as Freon, a condenser 12 to which the high-pressure and high-temperature vaporized cooling medium compressed in the compressor 10 is fed, an expansion valve 16 to which the liquefied cooling medium through condensation in the condenser 12 is fed through a first solenoid valve $V_1$ and an evaporator 18 to which the cooling medium expanded and vaporized through the expansion valve 16 is fed. Incidentally, a dryer 14 is interposed between the condenser 12 and the first solenoid valve $V_1$, and the moisture in the cooling medium is designed to be removed thereby. The evaporator 18 performs heat exchange between the vaporized cooling medium expanded through the expansion valve 16 and the freezing chamber 30 attached to the evaporator 18 to cool the freezing chamber 30 below the freezing point and allow the water injected into the freezing cells 34 to be frozen gradually. The vaporized cooling medium heated after heat exchange in the evaporator 18 is fed back to the compressor 10, compressed to a high temperature and a high pressure and recirculated.

A pipe 28 branches out from the outlet side of the compressor 10 and is connected through a second solenoid valve $V_2$ and a choking means 20 to the inlet side of the evaporator 18 to form a so-called hot gas circuit 24. The first solenoid valve $V_1$ and the second solenoid valve $V_2$ are designed to be switched over synchronously to assume states contrary to each other such that the first solenoid valve $V_1$ may be open (ON) during freezing operation to allow the cooling medium to circulate through the freezing circuit 22. In this state, the second solenoid valve $V_2$ is closed (OFF) to check circulation of the cooling medium through the hot gas circuit 24. Meanwhile, when ice releasing operation is started after completion of freezing operation in the freezing chamber 30 and ice cubes are allowed to fall, the state of the first solenoid valve $V_1$and that of the second solenoid valve $V_2$ are changed over synchronously. Namely, the first solenoid valve $V_1$ is closed (OFF) to check circulation of the cooling medium through the freezing circuit 22, while the second solenoid valve $V_2$ is let open (ON) to allow the high-temperature cooling medium (hot gas) to circulate through the hot gas circuit 24. Thus, the freezing chamber 30 attached to the evaporator 18 is heated to release adhesion of the ice cubes formed in the respective freezing cells 34 and let them fall by their own weights.

As described above, when the ice making machine is switched to ice releasing operation, the state of the first solenoid valve $V_1$ and that of the second solenoid valve $V_2$ are changed over synchronously (1) to stop circulation of the cooling medium in the freezing circuit 22 and (2) to feed the high-pressure and high-temperature vaporized cooling medium from the outlet side of the compressor 10 to the evaporator 18. However, as shown in FIG. 4, while the outlet side of the condenser 12 is closed by the first solenoid valve $V_1$, no closing means such as a valve is disposed to the inlet side of the condenser 12. Accordingly, the hot gas A delivered from the compressor 10 during ice releasing operation is not entirely fed to the hot gas circuit 24, but the substantial portion of the hot gas B is designed to be circulated through the hot gas circuit 24. A small amount of hot gas portion C flows into the condenser 12 where the heat of the hot gas is dissipated well and stays therein (this phenomenon is termed as "stagnation"). If some portion of the hot gas stagnates in the freezing circuit 22 connected to the condenser 12, the hot gas to be circulated through the hot gas circuit 24 decreases with time corresponding to the amount of stagnation C. It can thus be pointed out that the ice releasing capacity in the evaporator 18 is gradually lowered to require a considerable time for ice releasing operation, disadvantageously. Such problem occurs conspicuously when the ambient temperature is low. While problems occurring during freezing operation of the automatic ice making machine has been described, they are generally true with the freezing systems of freezers where defrosting is achieved by evaporators using a hot gas.

SUMMARY OF THE INVENTION

This invention is proposed in view of many problems inherent in the cooling medium circuit of prior art ice making machines and with a view to overcoming them successfully, and it is an object of the invention to provide a means for improving defrosting-ice releasing capacity particularly under low temperature conditions, when the frost deposited on the evaporator or the ice cubes formed in the freezing chamber are to be removed by feeding a high-temperature vaporized cooling medium (hot gas) to the evaporator.

In order to overcome the above problems and attain the intended object suitably, this invention provides a cooling medium circuit for ice making machines and the like, comprising a freezing circuit in which a high-pressure and high-temperature vaporized cooling medium compressed in a compressor is fed to a condenser, the cooling medium liquefied through condensation in the condenser is fed to an expansion means through a first solenoid valve, the cooling medium expanded and vaporized through the expansion means is fed to an evaporator to perform heat exchange and the thus heated vaporized cooling medium is fed back to the compressor; and a hot gas circuit in which the high-pressure and high-temperature vaporized cooling medium fed from the compressor is partly by-passed to the evaporator through a second solenoid valve and a choking means to achieve ice releasing and the like in the evaporator; wherein the state of the first solenoid valve and that of the second solenoid valve can be changed over synchronously each time the ice making machine is switched to freezing operation or to ice releasing operation to assume states contrary to each other; characterized in that the cooling medium fed from the condenser is designed to be partly by-passed to the compressor through a third solenoid valve.

DETAILED DESCRIPTION OF THE INVENTION

Figure 3:
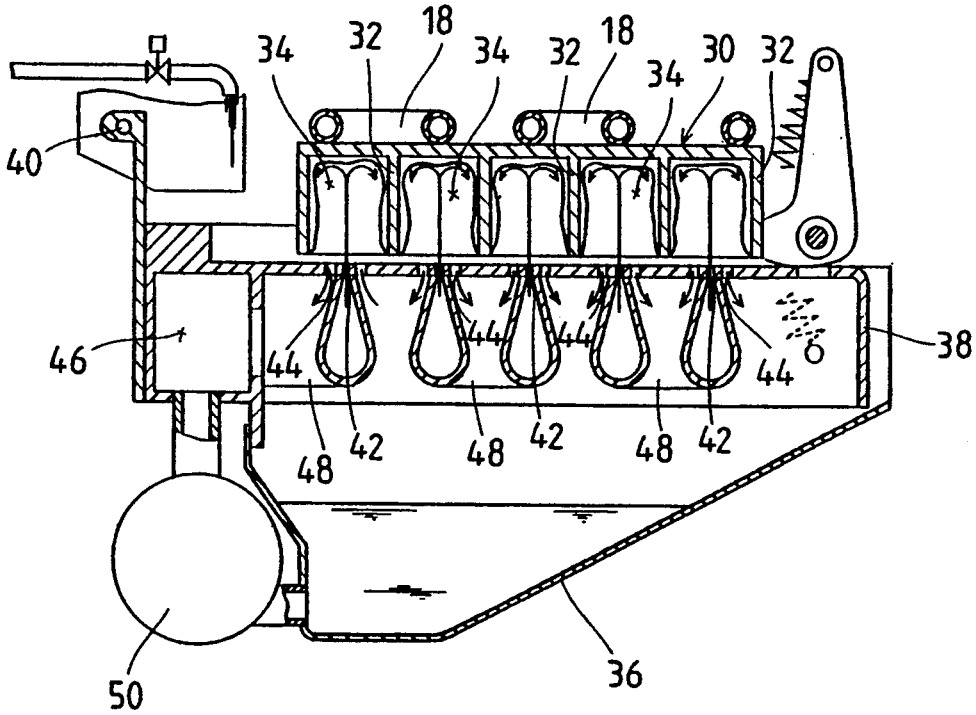
FIG.3 PRIOR ART
FIG. 3 shows schematically a constitution of a water injection system automatic ice making machine in which ice cubes are formed by jetting water to be frozen into the freezing cells opening downward.

The cooling medium circuit for ice making machines and the like according to this invention will be described below by way of a preferred embodiment referring to the attached drawings. It should be appreciated that the same members already described with respect to the freezing circuit and the hot gas circuit referring to FIG. 4 shall be denoted with the same reference numbers. While FIG. 1 shows the cooling medium circuit according to the preferred embodiment of the invention, which can be employed in a water injection system ice making machine described referring to FIG. 3, this circuit can also be applied generally to the freezing systems of freezers where defrosting is achieved by evaporators using a hot gas.

Figure 1:
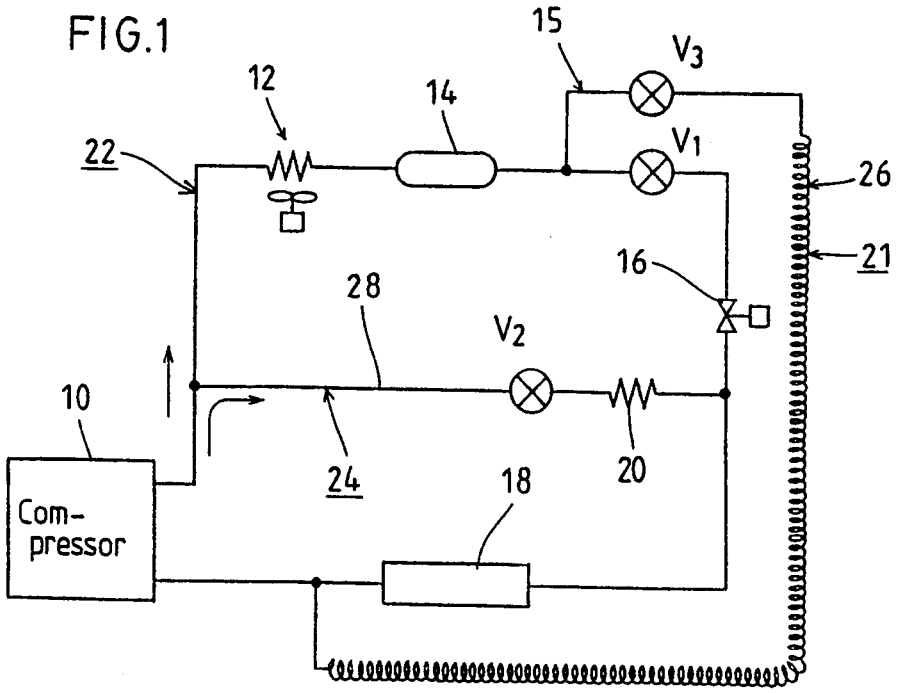
FIG. 1 shows schematically a constitution of the cooling medium circuit according to a preferred embodiment of the invention.
Figure 2:
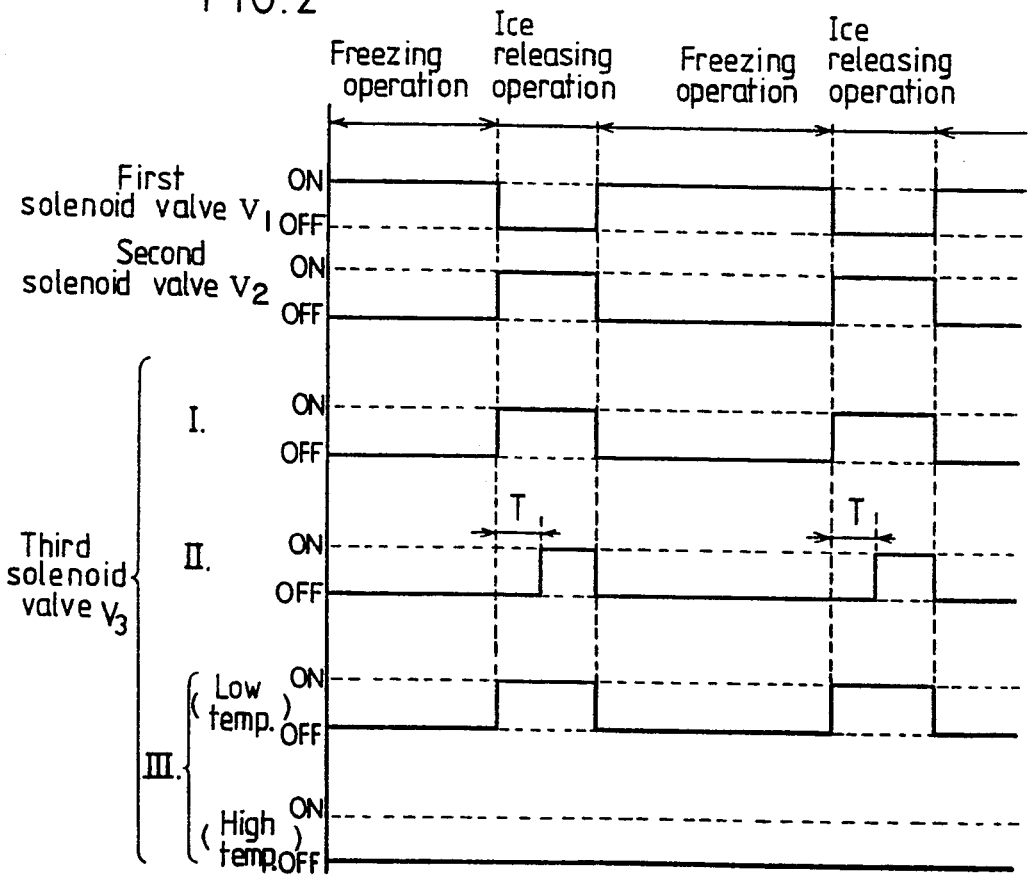
FIG. 2 shows an open-close timing chart of the first, second and third solenoid valves in the cooling medium circuit according to the preferred embodiment of the invention.
Figure 4:
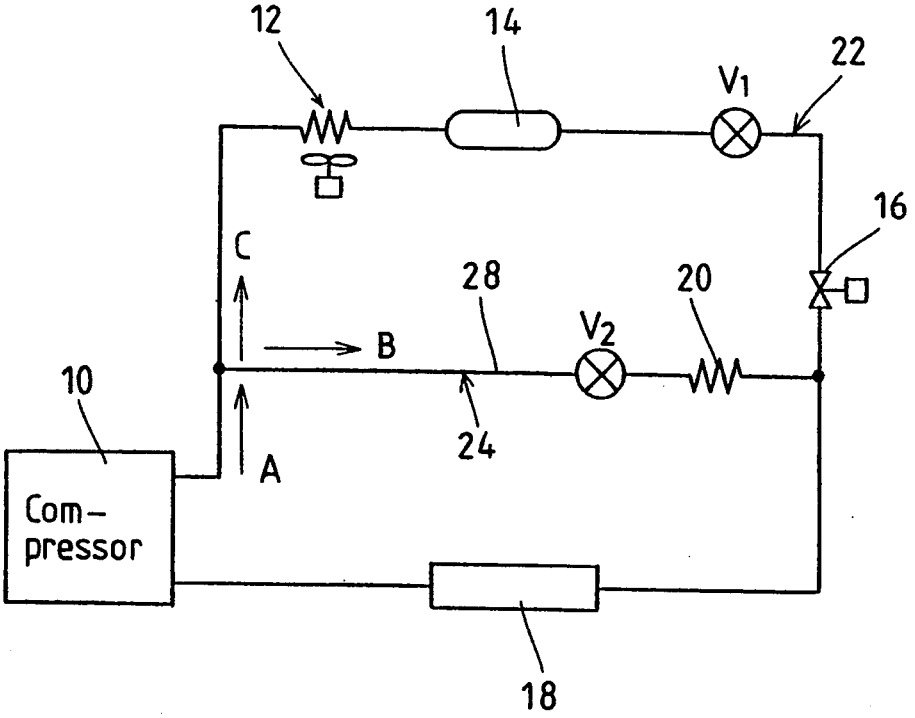
FIG.4 PRIOR ART
FIG. 4 shows schematically a constitution of the prior art freezing circuit to be suitably employed in the automatic ice making machine shown in FIG. 3.

The cooling medium circuit shown in FIG. 1 is substantially the same as that described referring to FIG. 4, and the difference is that a bypass circuit 21 is provided to feed the cooling medium from the condenser 12 partially to the compressor 10 through a third solenoid valve $V_3$. More specifically, in the cooling medium circuit according to the preferred embodiment, a pipe 15 branches out from the outlet side of the dryer 14 connected to the condenser 12, and the pipe 15 is communicatively connected to the suction side (outlet side of the evaporator 18) of the compressor 10. The reason why such solenoid valve $V_3$ is disposed to the outlet side of the dryer 14 is to remove preliminarily impurities in the cooling medium by the dryer 14, wherein the solenoid valve $V_3$ is directed to control the timing of feeding the cooling medium from the condenser 12 to the compressor 10; whereas the capillary tube 26 is directed to control the flow rate of the cooling medium. Accordingly, the diameter and length of the capillary tube 26 changes depending on the freezing capacity of the freezing circuit 22 and the choking level in the hot gas circuit 24. Incidentally, if the third solenoid valve $V_3$ is allowed to have a function of controlling flow rate of the fluid passing therethrough in addition to the valve open-close function, the capillary Lube may be omitted. However, since the capillary tube serves also as an expansion means for vaporization of the liquefied cooling medium at the outlet thereof, the solenoid valve $V_3$ must be allowed to have the function of expansion valve if the capillary tube is to be omitted. By providing such bypass circuit 21 having a third solenoid valve $V_3$ and by controlling the open-close timing of the solenoid valve $V_3$ in a suitable manner, stagnation of the hot gas in the freezing circuit 22 can be eliminated to allow ice releasing operation by the evaporator 18 to proceed efficiently. The open-close timing of the third solenoid valve $V_3$ can be classified into the following four patterns. The open-close timings of the first, second and third solenoid valves $V_1$, $V_2$ and $V_3$ are shown in FIG. 2.

I: To open (ON) normally the third solenoid valve $V_3$ and feed the liquefied cooling medium from the condenser 12 to the compressor 10 during ice releasing operation In this pattern, the open-close timing of the third solenoid valve $V_3$ is always synchronized with that of the second valve $V_2$. Namely, although stagnation of the hot gas occurred during ice releasing operation in the prior art freezing circuit to cause reduction in the ice releasing efficiency of the evaporator 18, such stagnation of the hot gas during ice releasing operation can be cleared to afford a greatly improved ice releasing capacity.

II: To feed the liquefied cooling medium by opening the third solenoid valve $V_3$ with a delay T after initiation of ice releasing operation The reason why such delay is secured is that the affect of hot gas stagnation manifests gradually with time. The delay T can suitably be adjusted by a timer provided in a control circuit (not shown).

III: (1) To close (OFF) the third solenoid valve $V_3$ even during ice releasing operation when the ambient temperature is high (at high temperatures); and (2) to open (ON) the third solenoid valve $V_3$ during ice releasing operation when the ambient temperature is low (at low temperatures) The reason is that not too much ice releasing capacity is necessary when the outer temperature is high, for example, in summer, but if the outer temperature is low, on the contrary, the ice releasing capacity will often be insufficient. Incidentally, switching over between the high-temperature control and the low-temperature control is achieved based on detection signals given by a thermosensitive means such as a thermostat.

IV: To open (ON) the third solenoid valve $V_3$ even during freezing operation and feed a cooling medium from the condenser 12 to the compressor 10 (without passing through the evaporator 18) in addition to the patterns I, II or III.

More specifically, the second solenoid valve $V_2$ is closed (OFF) and the first solenoid valve $V_1$ is let open (ON) to feed the liquefied cooling medium from the condenser 12 to the evaporator 18 during freezing operation. While the vaporized cooling medium passed through the evaporator 18 is to be fed back to the compressor 10, the temperature of the vaporized cooling medium is considerably elevated by heat exchange in the evaporator 18, so that the compressor 10 is liable to be overheated during operation. Therefore, like in the preferred embodiment, if the third solenoid valve $V_3$ is let open (ON) during freezing operation to feed the cooling medium, which is expanded and vaporized when it is delivered from the capillary tube 26, directly to the compressor 10 without passing through the evaporator 18, overheating of the compressor 10 can effectively be prevented with the aid of the unheated vaporized cooling medium.

Meanwhile, the bypass circuit 21 additionally provided according to the preferred embodiment allows the value of descent pressure (Pd)/saturation pressure (Ps) of the cooling medium during ice releasing operation to maintain a high level compared with the case where such additional circuit is not provided. Accordingly, the power of the hot gas circulating through the hot gas circuit 24 during ice releasing operation can be maintained to improve consequently the ice releasing capacity.

What is claimed is:

1. A cooling medium circuit for ice making machines and the like, comprising:

a freezing circuit in which a high-pressure and high-temperature vaporized cooling medium compressed in a compressor is fed to a condenser; the cooling medium liquefied through condensation in said condenser is fed to an expansion means through a first solenoid valve; the cooling medium expanded and vaporized through said expansion means is fed to an evaporator to perform heat exchange; and the thus heated vaporized cooling medium is fed back to said compressor; and a hot gas circuit in which the high-pressure and high-temperature vaporized cooling medium fed from said compressor is partly by-passed to the evaporator through second solenoid valve and a choking means to achieve ice releasing and the like in the evaporator; wherein the state of said first solenoid valve and that of said second solenoid valve can be changed over synchronously each time said ice making machine is switched to freezing operation or to ice releasing operation to assume states contrary to each other;

characterized in that a by-pass pipe for liquefied cooling medium is provided which branches out from an intermediate point between said condenser of said freezing circuit and said first solenoid valve, said by-pass pipe and said condenser are connected to each other via a third solenoid valve and a capillary tube which expands and vaporizes the liquefied cooling medium so that said liquefied cooling medium fed from said condenser is supplied to said compressor while being controlled in flow rate by said third solenoid valve.

2. The cooling medium circuit for ice making machines and the like according to claim 1, wherein said third solenoid valve is controlled to be open during ice releasing operation of said ice making machines and the like to allow the cooling medium from said condenser to be fed to said compressor.

3. The cooling medium circuit for ice making machines and the like according to claim 1, wherein said third solenoid valve is controlled to be open with a predetermined delay after ice releasing operation is started in said ice making machine and the like.

4. The cooling medium circuit for ice making machines and the like according to claim 1, wherein said third solenoid valve is controlled during ice releasing operation depending on the ambient temperature, such that said third solenoid valve may be open when the ambient temperature, whereas said third solenoid valve may be closed when the ambient temperature is higher than the present temperature.

5. The cooling medium for ice making machines and the like according to claim 1, wherein said third solenoid valve is controlled to be open even during freezing operation of said ice condenser to be fed to said compressor.

* * * * *